US006179188B1

(12) United States Patent
Gleason

(10) Patent No.: US 6,179,188 B1
(45) **Date of Patent: *Jan. 30, 2001**

(54) EXTERNAL FRAME BACKPACK WITH FLEXIBLE HARNESS

(75) Inventor: Dana W. Gleason, Bozeman, MT (US)

(73) Assignee: Dana Design, Ltd., Bozeman, MT (US)

( * ) Notice: Under 35 U.S.C. 154(b), the term of this patent shall be extended for 0 days.

This patent is subject to a terminal disclaimer.

(21) Appl. No.: 09/249,974

(22) Filed: Feb. 12, 1999

Related U.S. Application Data

(63) Continuation of application No. PCT/US97/13397, filed on Jul. 28, 1997, which is a continuation of application No. 08/689,821, filed on Aug. 14, 1996, now Pat. No. 5,762,251.

(51) Int. Cl.[7] ..... A45F 3/10
(52) U.S. Cl. ..... 224/641; 224/262
(58) Field of Search ..... 224/635, 636, 224/641, 644, 633, 263, 262

(56) References Cited

U.S. PATENT DOCUMENTS

| | | | | |
|---|---|---|---|---|
| 204,066 | | 5/1878 | Merriam | 224/636 X |
| 3,899,109 | * | 8/1975 | Noice | 224/635 X |
| 4,369,903 | * | 1/1983 | Wilkes | 224/635 |
| 4,480,775 | * | 11/1984 | Stanford | 224/635 |
| 5,503,314 | * | 4/1996 | Fiscus | 224/262 X |

FOREIGN PATENT DOCUMENTS

| | | |
|---|---|---|
| 2 652 727 | 4/1991 | (FR) . |
| WO 93/14669 | 8/1993 | (WO) . |

* cited by examiner

*Primary Examiner*—Renee Luebke
(74) *Attorney, Agent, or Firm*—Christensen O'Connor Johnson Kindness PLLC

(57) ABSTRACT

An external frame backpack (10) includes a frame (14), a hipbelt (32), two flexible stays (50, 52), back panel (38), and a lower panel (40). The frame is external and substantially rigid. It includes upper, middle, and lower frame members (22, 24, 26) secured between frame side rails (18, 20). The hipbelt is attached to the frame adjacent the lower frame member. The flexible stays are elongate with upper and lower ends. The upper ends are attached to the upper frame member. The lower ends are attached to the sides of the hipbelt. The stays are flexible to allow movement of the hipbelt as the stays bend while transmitting at least a portion of the weight held on the frame to the lower end of the stays. The back panel is vertically and horizontally tensioned and secured to the frame. The lower panel is secured between the side rails of the frame. The lower panel includes a support sheet (66) to maintain the shape thereof when tensioned between the side rails.

11 Claims, 6 Drawing Sheets

EXTERNAL FRAME BACKPACK WITH FLEXIBLE HARNESS

CROSS REFERENCE TO RELATED APPLICATIONS

This application is a continuation of International application PCT/US97/13397, filed Jul. 28, 1997 designating the United States, which is a continuation of U.S. application Ser. No. 08/689,821, filed Aug. 14, 1996, and now U.S. Pat. No. 5,762,251 priority from the filing dates of which are hereby claimed under 35 U.S.C. §120.

FIELD OF THE INVENTION

The present invention relates to backpack frames and harnesses for carrying loads, and more particularly, to harness systems for external frame backpacks.

BACKGROUND OF THE INVENTION

External frame backpacks are particularly well suited for carrying heavy, bulky loads by backpackers. The load is carried a small distance away from the back of the user and is secured to a rigid frame that can transmit the load primarily to the hipbelt. However, with conventional frames and hipbelts, the load is not effectively transferred to the sides of the hips, the location most comfortable over a long haul. Instead the load is mainly carried by the small of the back as the hipbelt sags and pulls from behind.

Some attempts at overcoming this loading have been made by the use of straps and other equipment. For example, one attempted solution employs T-shaped arms rigidly secured to the frame rails and extending forwardly to an attachment with the sides of the hipbelt. This arrangement will transfer the load to the sides of the user's hips, but may also cause the pack to shift or swing side to side with every natural hip movement of the user. The connection is kept somewhat rigid for effective transfer of the load to the user's hips.

Other problems with external frame pack harnesses involve the back and lower panels that are used to suspend the pack frame away from direct contact with the user's back. These panels are strapped to the side rails of the pack and held in tension horizontally. They may, therefore, develop horizontal wrinkles or folds that are uncomfortable on the back of the user. Furthermore, the load may not be effectively and evenly distributed across these panels for a comfortable carry.

Owing to the limitation of the current external frame packs, the advantages of these packs being effective big-load haulers is overshadowed. A need therefore exists for a rigid external frame pack with a flexible harness system that effectively carries a load comfortably on the back with the bulk of the downward force being transferred to the sides of the hips of the user without pack instabilities being created when hiking.

SUMMARY OF THE INVENTION

The present invention provides a backpack including a rigid frame and flexible harness system for carrying a load on the back of a user such as a hiker. The backpack includes an external frame, a hipbelt, and a first flexible elongate stay. The frame is substantially rigid and includes an upper frame member and a lower frame member. The hipbelt is attached to the frame adjacent the lower frame member. The first flexible elongate stay is attached to the upper frame member at an upper end of the stay. It is attached to the hipbelt at a lower end of the stay. The stay is flexible to allow movement of the hipbelt as the stay bends while transmitting at least a portion of the weight held on the frame to the lower end of the stay.

Preferably, the upper end of the stay is anchored directly to the upper frame member. The lower end is attached to the sides of the hipbelt. Thus loads are directly transmitted from the frame to the sides of the hipbelt. In one aspect of the invention, the frame includes a middle member around which the stay bends between its attachment to the upper member and the hipbelt.

A preferred aspect of the invention includes a second flexible elongate stay attached to the upper member and the hipbelt on the opposite side of the frame and hipbelt from the first stay.

According to another preferred aspect of the present invention, an adjustment mechanism is provided between the hipbelt and the first stay and between the hipbelt and the second stay. The adjustment mechanism allows the user to move the lower ends of the stays forwardly and rearwardly relative to the frame and hipbelt. The stays are held at least partially within flexible socks extending from the lower ends of the stays and attached to the hipbelt adjustment mechanism. The stays are removably secured within the socks such that alternative stays may be attached to the frame and hipbelt.

Another preferred aspect of the invention includes a back panel secured to the front side of the frame. Both horizontal and vertical straps are employed to secure the back panel. The vertical strap is secured to the upper member and the lower member to vertically tension the back panel. The vertical strap extends from the back panel over the upper frame member and below the lower frame member. Tensioning mechanisms are used to tension both the vertical and horizontal straps of the back panel. The back panel also includes a flexible, horizontal bar extending across the panel between the side rails. The back panel includes a vertical row of horizontal slots therein for securing shoulder straps thereto in a plurality of positions relative to the frame.

A lower panel is also secured to the frame generally between the side rails and beneath the back panel. The lower panel includes a support sheet secured thereto for maintaining the shape of the lower panel as it is tensioned to the frame. The support sheet is constructed of a relatively rigid material and extends substantially to the top and bottom of said lower panel for providing vertical support to said lower panel.

BRIEF DESCRIPTION OF THE DRAWINGS

The foregoing aspects and many of the attendant advantages of this invention will become better understood in view of the drawings wherein.

DETAILED DESCRIPTION OF THE PREFERRED EMBODIMENT

Figure 1:
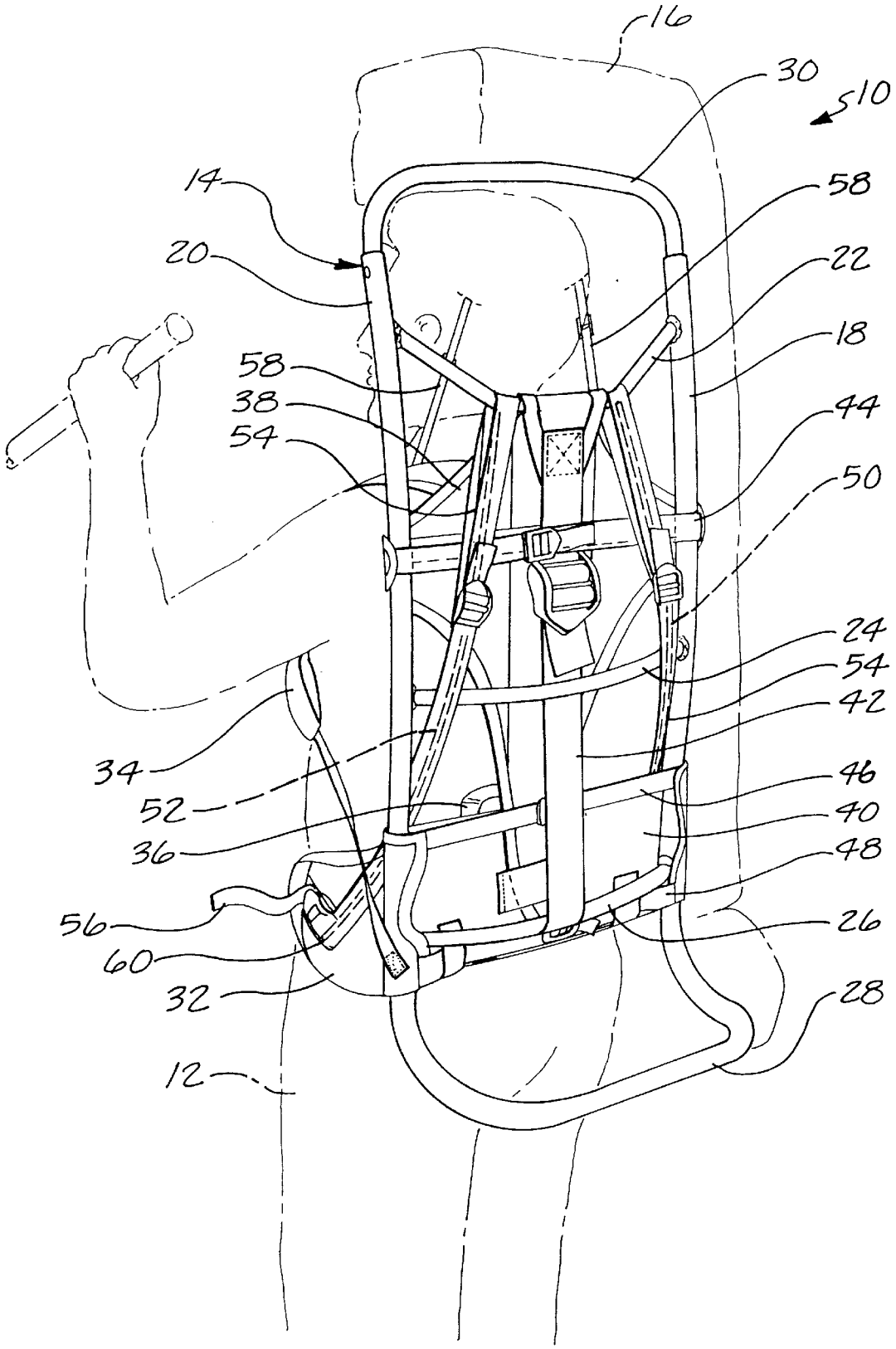
FIG. 1 provides perspective view of the external pack frame and harness system of the present invention shown on the back of a hiker with the pack bag shown in phantom.

Referring now to the FIGURES, the preferred embodiment of the external frame pack of the present invention will now be described. A backpack 10 of the type generally used on the back of a hiker 12 is provided. The pack includes a frame 14 and a bag 16 (shown in phantom). Frame 14 may be of somewhat conventional or non-conventional construction. Frame 14 may be constructed of aluminum, other metals, composite materials, or other suitable materials. Bag 16 can be any conventional or non-conventional load-carrying structure that is held on and by frame 14.

In the preferred embodiment of the invention, frame 14 includes a right side rail 18 and a left side rail 20 that are generally parallel and vertically oriented when pack 10 is on the back of hiker 12. Preferably, side rails 18 and 20 extend from just below the back of hiker 12 to near the top of the head of hiker 12. Frame 14 also includes upper, middle, and lower crossbars 22, 24 and 26. These crossbars extend between right and left side rails 18 and 20 to form somewhat of a ladder configuration with the side rails. Upper crossbar 22 extends just below the upper ends of side rails 18 and 20, from one side to the other. From either end of upper crossbar 22, upper crossbar angles somewhat downwardly at approximately 45–60° to a midsection which is generally horizontal when the pack is in the upright position on the back of hiker 12. Approximately the middle third of upper crossbar 22 is horizontal with the first and last thirds being angled downwardly and somewhat rearwardly, away from the head of hiker 12. As with middle crossbar 24 and lower crossbar 26, the ends of upper crossbar 22 are welded in a conventional manner to side rails 18 and 20. Alternatively, other conventional or non-conventional means of attachment may be employed.

Middle crossbar 24 extends just below the midpoints of side rails 18 and 20 in a generally horizontal fashion. Middle crossbar 24 has a slightly arcuate shape, such that it bows rearwardly from its ends to its midsection away from hiker 12. Likewise, lower crossbar 26 bows rearwardly but is substantially horizontal in the preferred embodiment. Lower crossbar 26 extends from near the lower ends of side rails 18 and 20. Frame 14 also includes a shelf 28 extending downwardly and rearwardly from side rails 18 and 20. Preferably, shelf 28 is an integrally bent portion of right and left side rails 18 and 20. Thus, side rails 18 and 20 are formed from the same piece of tubular aluminum forming a U-shape. The bottoms of right and left side rails 18 and 20 bend rearwardly and inwardly and then directly toward each other to the center of shelf 28. Shelf 28 may provide additional support to bag 16 or other items to be carried beneath bag 16 such as a tent or sleeping bag. In the preferred embodiment of the invention shelf 28 and most of frame 14, is of a conventional construction, but may alternatively be modified to any conventional or non-conventional form.

Frame 14 further includes an extension tube 30 projecting upwardly from the top ends of side rails 18 and 20 in an inverted U-shape configuration. As with many conventional external frame packs, extension tube 30 may be extended or retracted relative to side rails 18 and 20, the lower ends of extension tube 30 being telescoped within the upper ends of sides rails 18 and 20.

The present invention is meant to deal with any sort of external frame and provide a comfortable flexible harness for such a frame. Such external frames are particularly efficient at carrying large loads comfortably on the back of hiker 12. Such a rigid frame as the one described above will hold a large load on the back of the hiker while keeping the load slightly removed from direct contact with the hiker and providing a rigid support for the load.

The interface between the frame, which carries the load and hiker 12 is the harness system. The present invention provides a unique harness system that is more durable, more comfortable, and transfers the load out to the sides of the hips in a more efficient manner, while still allowing flexibility of movement of the hiker with a rigid external frame without upsetting the balance of the frame and the load.

The harness system of the present invention includes a hip belt 32 including a lumbar pad 36, shoulder straps 34, a back panel 38, and a lower panel 40. Hip belt 32 is constructed generally according to conventional high-end hip belts on the market with the exception of a load strap 56 and an attachment structure for flexible stays as will be described below. Hip belt 32 is secured to lower panel 40 and thus to frame 14. It should be noted that the majority of the load of pack 10 is carried by hiker 12 at the hips such that hip belt 32 transfers the load to hiker 12. Shoulder straps 34 help stabilize the load and hold frame 14 near the back of hiker 12 but are not intended as primary load carrying members, as the comfort of hiker 12 is much greater with the load being carried primarily at the hips. A lumbar pad 36 is positioned in the middle of hip belt 32 to nest in the small of the back of hiker 12.

Should straps 34 extend from back panel 38 over the shoulder of hiker 12 and down to a lower portion of side rails 18 and 20 of frame 14. Shoulder straps 34 may be somewhat conventional in construction. However, the upper attachment structure of shoulder straps 34 is non-conventionally attached to back panel 38 as will be described in more detail below. A sternum strap (not shown) may also be secured between the forward sides of shoulder straps 34 in a more conventional manner.

Back panel 38 has the function of resisting the forwardly directed forces paced on frame 14 by shoulder strap 34 to keep frame 14 removed from direct contact with the back of hiker 12. Back panel 38 thus, also keeps the load within bag 16 removed from direct contact with the back of hiker 12. Unlike conventional back panels, back panel 38 has somewhat of a cross-shaped or diamond configuration. The upper end of back panel 38 extends around the midsection of upper crossbar 22. The lower end of back panel 38 extends beneath lower crossbar 26. The right and left corners of back panel 38 extend around right and left side rails 18 and 20, respectively. The upper end and lower ends of back panel 38 are tensioned and pulled taut with vertical tension strap 42 which extends between the ends on the opposite side of upper crossbar 22 and lower crossbar 26. The function and advantages of vertical tension strap 42 will be discussed in more detail below in connection with FIGS. 4–6. A horizontal tension strap 44 is also employed to pull the right and left corners of back panel 38 into a taut position.

Lower panel 40 also includes horizontal straps 46 and 48 to hold lower panel 40 taut to resist the forces pushing frame 14 against the lower back of hiker 12. Upper strap 46 extends between the upper corners of the rectangular shaped lower panel 40 while lower strap 48 extends between the lower corners. Each of straps 46 and 48 include a buckle or other tensioning member to increase the tension on lower panel 40. Unlike back panel 38 lower panel 40 does not include a vertical tension strap. As explained below, other means are employed to ensure the vertical extension of lower panel 40.

Another unique feature of the present invention includes right and left flex stays 50 and 52 that transfer the load of pack 10 to the sides of the hips of hiker 12 rather than having the entire load rest in the center of the lower back or lumbar region of hiker 12. Flex stays 50 and 52 are preferably constructed of fiber glass composite rods that extend from upper crossbar 22 behind middle crossbar 24 in front of lower panel 40 to a connection to the sides of the hip belt 32. As explained below in more detail in connection with FIGS. 2 and 3, load straps 56 are connected to the lower ends of stays 50 and 52. Stays 50 and 52 are also held within stay webbing 54. Webbing 54 provides enclosed socks to hold the lower two-thirds of each of flex stays 50 and 52, while the upper third portion of webbing 54 is not sewn at its edges into a sock configuration to allow for tensioning of webbing 54 by looping it over the top of upper crossbar 22 and by utilizing adjustment sliders or buckles.

Also illustrated in FIG. 1 are lift straps 58 extending from the top forward side of shoulder straps 34 to an attachment with bag 16. Alternatively, lift straps 58 may attach directly to frame 14. Lift straps 58 work in a conventional manner to take the load from shoulder straps 34 and transfer it into the frame to be carried by hip belt 32 on the hips of hiker 12. In the present invention, lift straps 58 also function to pull frame 14 closer to the back of the user and help pre-load flex stays 50 and 52.

Figure 2:
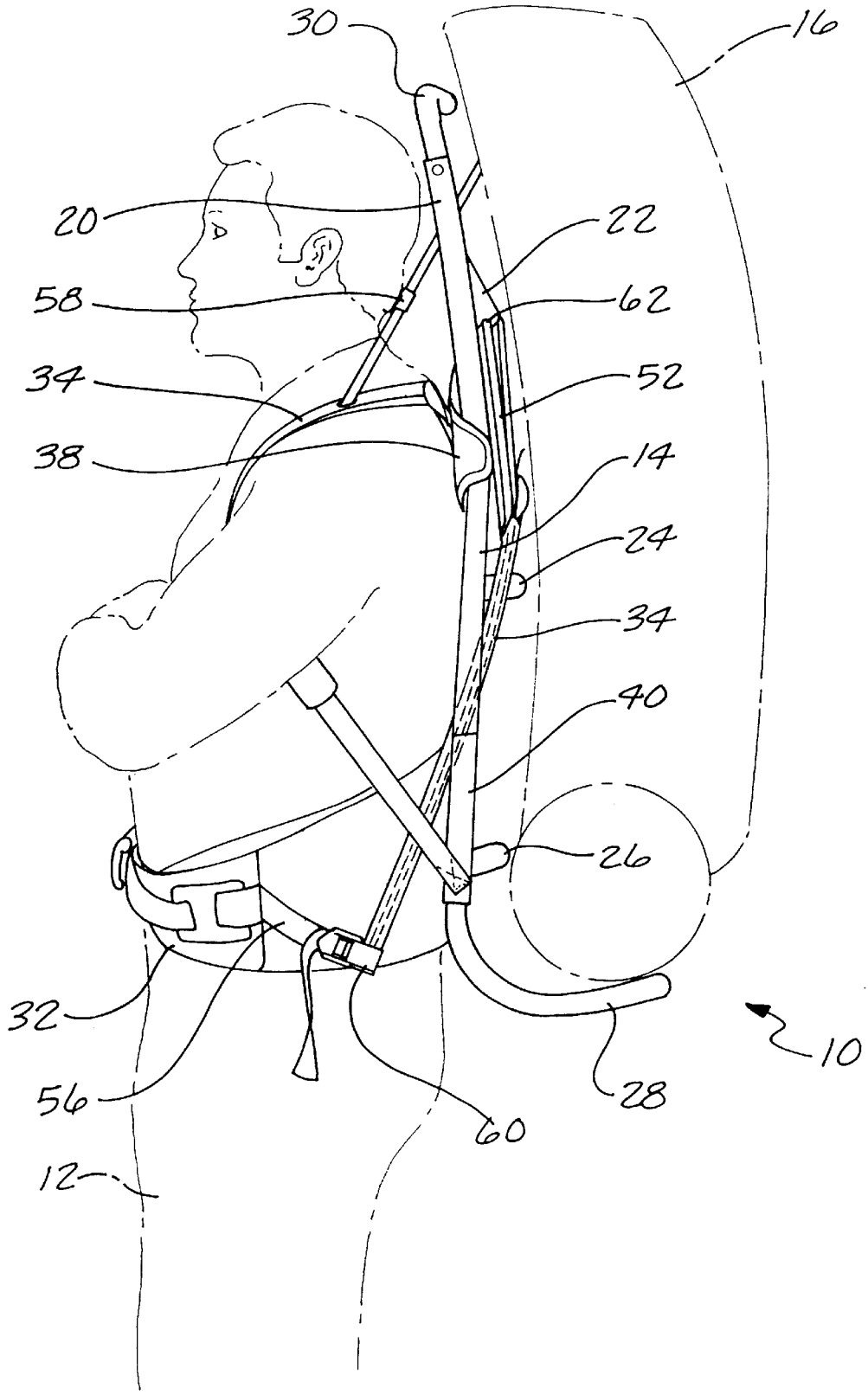
FIG. 2 is a side elevational view of the external frame and harness system on the back of a hiker.

Referring now to FIG. 2, note that the lower ends of flex stays 50 and 52 are received within lower receivers 60 which form a pocket at the rearward ends of load straps 56 attached to hip belt 32. Webbing 54 is attached directly to lower receiver 60 by being sewn therein or otherwise attached. The upper ends of flex stays 50 and 52 extend within upper receivers 62, upper receivers 62 are constructed preferably by providing holes in the bottom of upper crossbar 22 sized to receive flex stays 50 and 52 at approximately the bends in upper crossbar 22. Thus, the connection of the upper ends of flex stays 50 and 52 directly with external frame 14 allows the load to be transferred through stays 50 and 52 to hip belt 32. Due to the flexible nature of flex stays 50 and 52, hiker 12 is able to move such as when walking or otherwise climbing and hiking with flex stays 50 and 52 bending and moving with hiker 12 while still supporting the load contained within bag 16 on frame 14. Thus, a rigid external frame is employed with a flexible harness that transfers the load to the sides of the hips of hiker 12 instead of carrying the load in the lumbar region of the back or on the shoulders. This is a much more comfortable configuration and location to carry the load and hiker 12 is thus able to hike with more comfort and less fatigue or uncomfortable hot spots.

The upper ends of flex stays 50 and 52 could alternatively be connected to bag 16, another portion of frame 14 or even could be interconnected with lift straps 58. The basic functioning of flex stays 50 and 52 is still to transfer the load to the sides of the hips of the user while providing a flexible harness between the user and the load such that the entire load does not shift when hiker 12 moves his or her hips while carrying the load.

Figure 3:
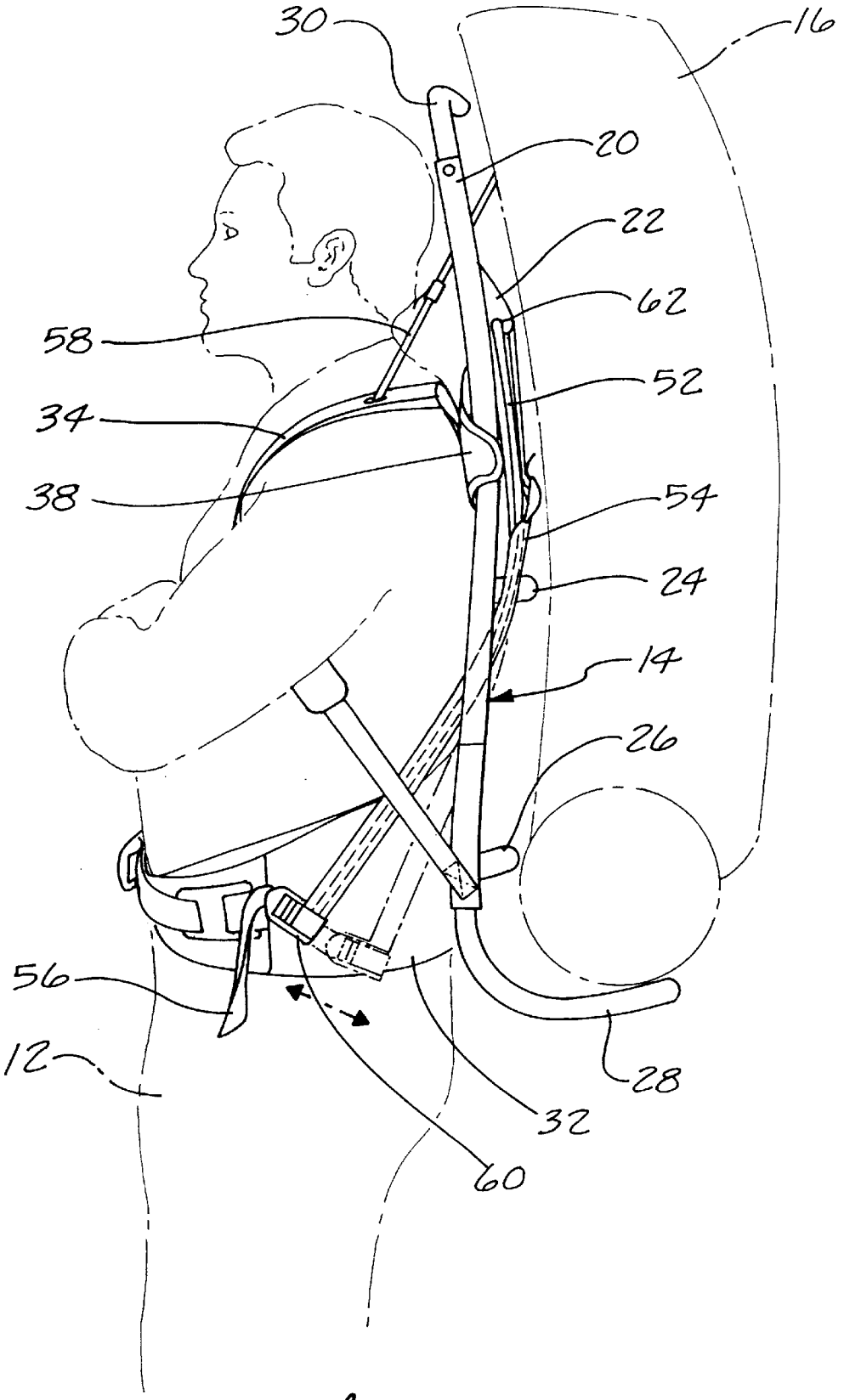
FIG. 3 is another side elevational view of the pack of the present invention with the flex stays in a further loaded configuration.

FIG. 3 illustrates the functioning of load straps 56, which further enhance the adjustable and load carrying features of the harness system of the present invention. By pulling load strap 56 into a tighter position flex stays 50 and 52 may be further bent into a higher pre-load condition. Such adjustment has the effect of further transferring the load forward on the hips of the user and holding the load in a more stable position while still allowing flexibility of the harness system. The lack of flexibility in prior art harness systems has contributed to the shift of the use of external from packs to internal frame packs. However, as discussed above in the background, internal frame packs are not as efficient as load carriers and do not provide the same comfort benefits of having a cooler interface between the load and hiker. However, the flex stays of the present invention allow the harness to move with the hiker while the load is more isolated from such movements and can remain more stable and rigid. While hiking, the preload on flex stays 50 and 52 can easily be changed by hand so as to vary the positioning and feel of pack 10 on the back and hips of hiker 12. Similarly, lift straps 58 may be adjusted while hiking to change the preload of flex stays 50 and 52 and shift the weight of pack 10 for more comfortable transit. Through this harness system the load may be pulled closer to the back and rides more stable with movements of the hiker since the harness is flexible and forgiving while the frame remains rigid and able to efficiently and effectively carry a large load.

Figure 4:
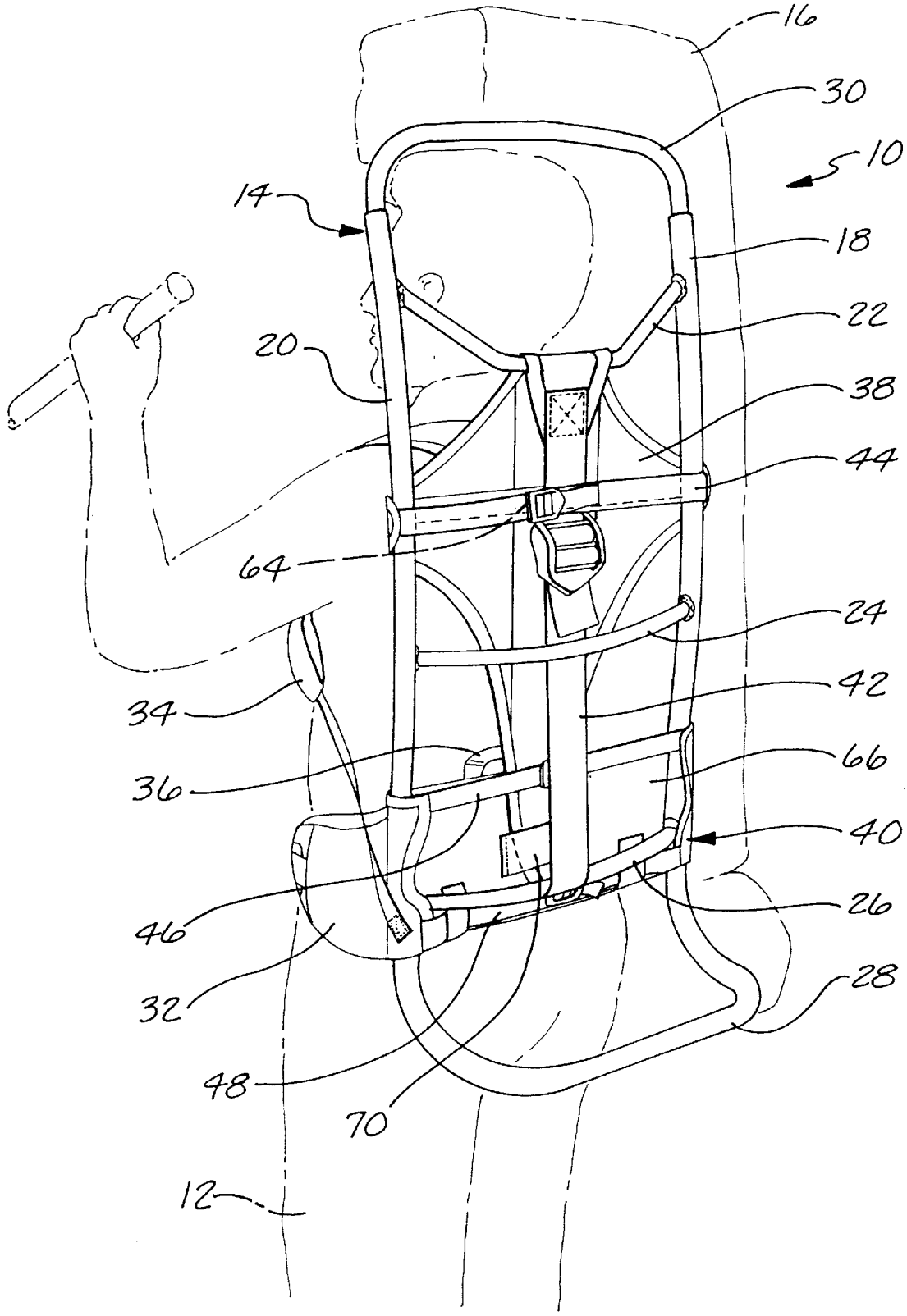
FIG. 4 provides a perspective view of the frame and harness system focusing on the back and lower panels with the flex stays removed.
Figure 5:
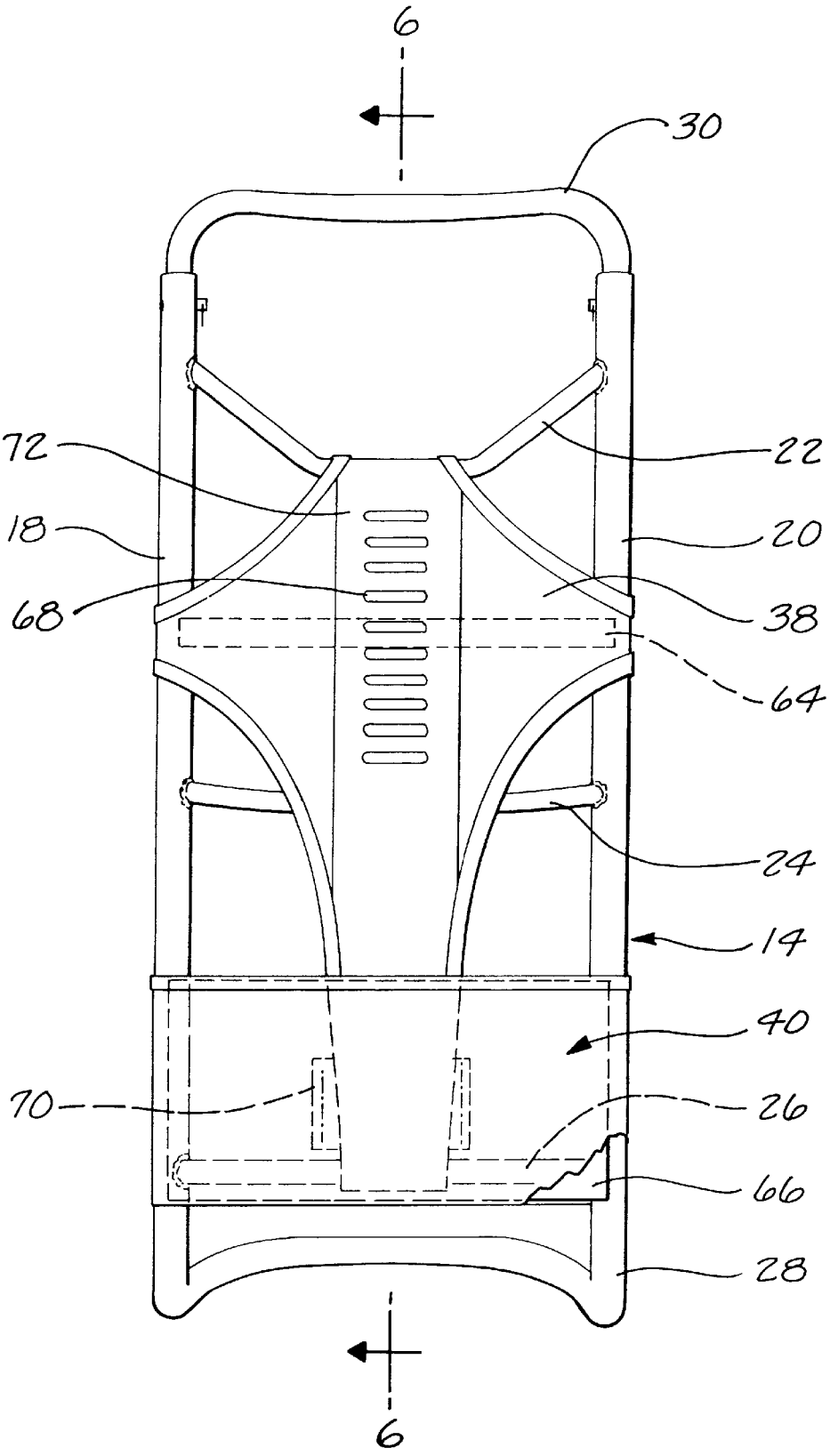
FIG. 5 is a front elevational view of the pack frame and harness system illustrated in FIG. 4 without the shoulder straps and hip belt.
Figure 6:
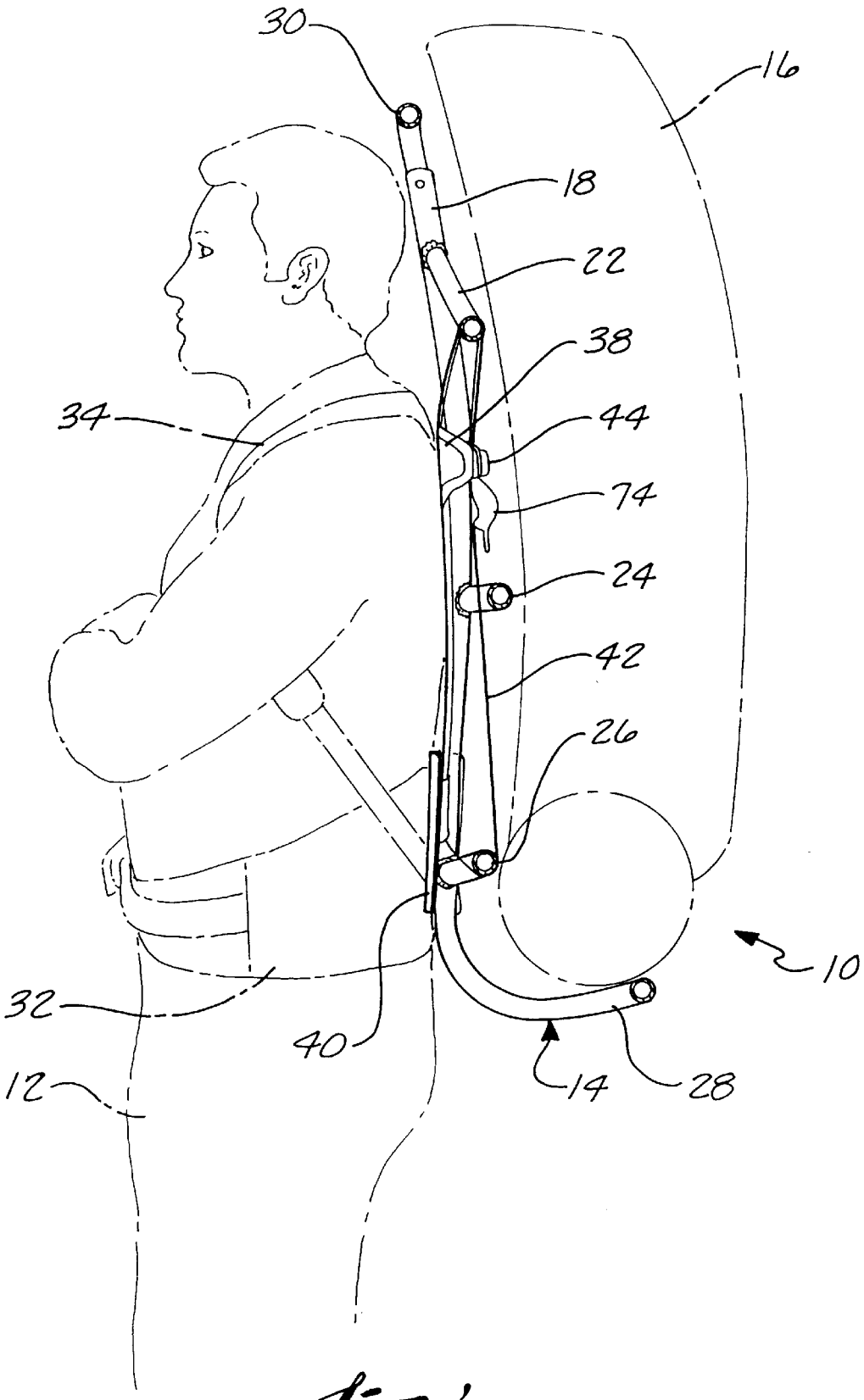
FIG. 6 is a side elevational view of a cross-cut through the center of the frame with the hiker, the hip belt, the shoulder strap and the bag shown in phantom.

Referring now to FIGS. 4–6, further details of back panel 38 and lower panel 40 will not be discussed. Note in these figures that flex stays 50 and 52 as well as lift straps 58 have been removed for clarity of presentation of back panel 38 and lower panel 40. As discussed above, back panel 38 has a generally diamond or cross-shaped configuration. The angled sides of back panel 38 are somewhat inwardly curved to eliminate areas of slack when horizontal tensioning strap 44 and vertical tensioning strap 42 are properly tightened. The entire panel is thus held in a taut configuration without any sliding in one direction or the other to cause any wrinkles in back panel 38. Thus, back panel 38 is much more comfortable to the back of the hiker 12 and more evenly distributes the load placed thereon while maintaining the proper spacing for coolness between pack 10 and hiker 12.

As discussed briefly above, the right and left corners of back panel 38 extend at least partially around the sides of right and left side rails 18 and 20. Horizontal tensioning strap 44 pulls the corners toward each other with the use of the slider buckle or other fastening device. Since the upper and lower corners of back panel 38 extend above upper crossbar 22 and below lower crossbar 26, respectively, back panel 38 has a longitudinal axis that is generally vertical. The upper and lower corners of back panel 38 extend over the crossbars and are tensioned together with vertical tensioning strap 42. Vertical tensioning strap 42 likewise includes a slider buckle assembly for tightening the connection and increasing the tension in a vertical direction on back panel 38. The lower end of back panel 38 extends through sleeve 70 sewn into the back of lower panel 40 to maintain the centered orientation of the lower end of back panel 38. Back panel 38 is preferably constructed with multiple layers of fabric and other material to provide a cool interface between the back of the user and frame 14, to properly transmit the forces involved, and to connect shoulder straps 34, as discussed in connection with FIG. 5. A horizontal flex bar 64 is also positioned within back panel 38. Horizontal flex bar 64 extends within back panel 38 in a horizontal configuration from side rail 18 to side rail 20. Horizontal flex bar 64 is a flat bar of preferably fiber glass material. Horizontal flex bar 64 helps to transmit the load to frame 14, while being flexible and comfortable within back panel 38.

Referring to FIGS. 4 and 5, lower panel 40 is constructed with a fabric material that is stretched around the lower ends of side rails 18 and 20 adjacent the connection of side rails 18 and 20 with lower crossbar 26. Lower strap 48 extends beneath lower crossbar 26 while upper strap 46 extends above lower crossbar 26. Tensioning of upper strap 46 and lower strap 48 increases the tension of lower panel 40. As seen in more detail in FIG. 5, lower panel 40 also includes a plastic panel sheet 66 secured to the back of the fabric layer of lower panel 40. Panel sheet 66 extends from side rail to side rail and from top to bottom of panel 40 to provide some rigidity to lower panel 40. Thus, the positioning and height of lower panel 40 does not change in a vertical direction as it is tensioned. Panel sheet 66 keeps the upper and lower extremities in their proper location so that no bunching of the fabric creates ripples, and the load is dispersed with the widest possible area. Panel sheet 66 is preferably constructed of a plastic material, but alternatively may be constructed of another somewhat flexible material that is stiff relative to the fabric used in lower panel 40 so as to maintain the basic shape of lower panel 40 for proper transmission of the loads involved.

FIG. 5 also illustrates slots 68 that are used to secure shoulder straps 34 to back panel 38. The midsection of back panel 38 includes an attachment strip 72 extending along the longitudinal axis thereof. Attachment strip 72 is preferably constructed of a Hypalon® material. Hypalon® is a composite rubber (or plastic) and fabric material. Horizontal slots 68 are provided in attachment strip 72 spaced vertically one from another to locate and attach shoulder straps 34. The ends of shoulder straps 34 are joined together and include hook and loop material to slip through one of slots 68 back out through a lower slot 68 and then fasten back on to itself. In this manner, shoulder straps 34 may be adjusted along the vertical longitudinal axis of back panel 38 for proper sizing to suit a particular individual. Preferably, the hook and loop fastener strip of shoulder straps 34 extends between an upper slot and a lower slot, five slots down from the upper slot selected.

FIG. 6 illustrates the vertical path of back panel 38 and vertical tensioning strap 42 for proper tensioning and load distribution of back panel 38 as discussed above. Note that a fastener 74 allows the tension in back panel 38 to be adjusted in a vertical direction. The vertical tensioning strap extends from the upper end of back panel 38 around the middle section of upper crossbar 22 behind middle crossbar 24 around lower crossbar 26 to its connection with the lower end of back panel 38. The larger and more evenly tensioned back panel 38 more comfortably and effectively transfers the load and stably holds the pack 10 on the back of hiker 12.

While the preferred embodiment of pack 10 has been illustrated and described, it will be apparent that various changes can be made therein without departing from the spirit and scope of the invention. For example, the attachment of the upper ends of flex rods 50 and 52 may be to other locations rather than to upper crossbar 22. Also note that flex rods 50 and 52 may be changed by sliding them from within webbing and replacing them with other rods to increase or decrease the stiffness depending on a particular load or individual. Other changes to the system could also be made wile still falling within the scope of the invention as defined by claims.

The embodiments of the invention in which an exclusive property or privilege is claimed are defined as follows:

1. A backpack comprising:

(a) an external, substantially rigid frame having an upper frame member and a lower frame member;

(b) a hipbelt attached to said frame adjacent said lower frame member; and (c) a first flexible elongate stay attached to said upper frame member at an upper end thereof and attached to said hipbelt at a lower end thereof, said stay being flexible to allow movement of said hipbelt as said stay bends while transmitting at least a portion of the weight held on said frame to the lower end of said stay, and;

(d) an adjustment mechanism coupled to a portion of said first stay and adjustable while being worn during use for resiliently flexing said first stay to adjust a preload applied to said first stay.

2. The backpack of claim 1, wherein the upper end of said stay is anchored directly to said upper frame member and said lower end is attached to the sides of said hipbelt for direct transmission of loads from said frame to the sides of said hipbelt.

3. The backpack of claim 2, wherein said frame further comprises a middle member, said stay bending behind said middle member between its attachment to said upper member and said hipbelt.

4. The backpack of claim 3, further comprising a second flexible elongate stay attached to said upper member and said hipbelt on the opposite side of said frame and hipbelt from said first stay.

5. The backpack of claim 4, wherein said adjustment mechanism comprises a first strap and buckle attached between said hipbelt and said first stay and a second strap and buckle attached between said hipbelt and said second stay for moving the lower ends of said stays forwardly and rearwardly relative to said frame and said hipbelt.

6. The backpack of claim 5, wherein said stays are held at least partially within flexible socks extending from the lower ends of said stays and attached to said hipbelt.

7. The backpack of claim 6, wherein said stays are removably secured within said socks for attachment of alternative stays to said frame and hipbelt.

8. The backpack of claim 1, wherein said adjustment mechanism comprises a first strap and buckle attached between said hipbelt and said first stay for moving the lower end of said stay forwardly and rearwardly relative to said frame and said hipbelt.

9. The backpack of claim 1, further comprising a back panel secured to the front side of said frame with a horizontal strap and a vertical strap, said vertical strap being secured to said upper member and said lower member to vertically tension said back panel.

10. The backpack of claim 9, further comprising a lower panel secured to said frame beneath said back panel, said lower panel including a support sheet secured thereto for maintaining the shape of said lower panel as said lower panel is tensioned to said frame.

11. An external frame backpack comprising:

(a) an external substantially rigid frame having upper, middle, and lower frame members secured between frame side rails;

(b) a hipbelt attached to said frame adjacent said lower frame member;

(c) two flexible elongate stays attached to said upper frame member at upper ends of said stays and adjustably attached to the sides of said hipbelt at lower ends of said stays for adjustable forward and rearward movement relative to said frame and said hipbelt, said stays being flexible to allow movement of said hipbelt as said stays bend while transmitting at least a portion of the weight held on said frame to the lower end of said stays;

(d) a vertically and horizontally tensioned back panel secured to said frame; and (e) a lower panel secured between said side rails of said frame, said lower panel including a support sheet to maintain the shape thereof when tensioned between said side rails.

* * * * *